United States Patent [19]

Wunner

[11] 4,363,224

[45] Dec. 14, 1982

[54] WARP KNITTING MACHINE WITH SLIDER NEEDLES

[75] Inventor: Roland Wunner, Bernstein, Fed. Rep. of Germany

[73] Assignee: Liba Maschinenfabrik GmbH, Naila, Fed. Rep. of Germany

[21] Appl. No.: 234,624

[22] Filed: Feb. 17, 1981

[30] Foreign Application Priority Data

Feb. 15, 1980 [DE] Fed. Rep. of Germany ..... 3005787

[51] Int. Cl.[3] ..... D04B 35/04

[52] U.S. Cl. ..... 66/120

[58] Field of Search ..... 66/120

[56] References Cited

U.S. PATENT DOCUMENTS

Re. 30,931 5/1982 Winter ..... 66/120

3,952,551 4/1976 Kohl ..... 66/120

*Primary Examiner*—Ronald Feldbaum

*Attorney, Agent, or Firm*—Anthony A. O'Brien

[57] ABSTRACT

A warp knitting machine is disclosed as including slider needles, each of which has a needle shank of channel form with a hook head and a slider that covers the hook opening of the needle shank by means of a cover member fitted on the slider shank, such cover member is shorter than the hook opening of the needle shank, and the slider has such a cross-section that it carries the stitch in each instance without being supported on the needle shank and/or the hook head.

3 Claims, 7 Drawing Figures

WARP KNITTING MACHINE WITH SLIDER NEEDLES

BACKGROUND OF THE INVENTION

1. Field of the Invention

This invention relates to a warp knitting machine and more particularly, to the slider needle arrangement of such a warp knitting machine. The slider needles each have a needle shank of channel form with hook head and a slider which covers the hook opening of the needle shank with a cover part fitted on a slider shank, wherein needle shank and slider are moved in relation to one another so that the slider does not come into contact with the bottom of the channel of the needle shank.

2. Description of the Prior Art

Such a warp knitting machine in known from German Patent Ap. No. 1,760,140. In this machine the important point is that the transition of the cover part into the slider shank (called the angle point) remains in the channel of the needle shank in every position of the relative movement of needle shank and slider, so that in each case the stitch is carried by the needle shank until the slider has covered the hook opening. This configuration leads to difficulties when it is necessary to lay a relatively large number of threads, for example six threads, into the hook opening, since in such a case the hook opening would have to be correspondingly long. Then the cover part of the slider would also have to have a corresponding length. The rigidity of the cover part would thereby be reduced in an undesired manner. This could lead to the tip of the cover part colliding with the hard head in the relative movement of slider and needle shank.

SUMMARY OF THE INVENTION

The invention is summarized in a warp knitting machine with slider needles which have a needle shank of channel form with hook head and a slider that covers the hook opening of the needle shank with a cover part fitted on a slider shank, where needle shank and slider are moved in relation to one another so that the slider does not come into contact with the bottom of the channel of the needle shank, characterized in that the cover part is so far shorter than the hook opening that on closure of the hook opening by placing of the end of the cover part opposite to the hook head the transition of the cover part into the slider shank has come out of the region of the channel, while the slider possesses such a cross-section that it carries the stitch in each case without being supported on the needle shank and hook head.

An object of the present invention is to construct the slider needles of a warp knitting machine with the covering part that is shorter than the hook opening of the needle shank.

Other objects and advantages of the present invention will become apparent from the following description taken in conjunction with the accompanying drawings.

DESCRIPTION OF THE PREFERRED EMBODIMENT

The present invention is based upon the problem of forming such a slider needle so that this danger is avoided. In accordance with the invention this is effected in that the cover part is so much shorter than the hook opening that on closure of the hook opening by placing of the end of the cover part opposite to the hook head the transition of the cover part into the slider shank has come out of the region of the channel, while the slider possesses such a cross-section that it carries the stitch in each case without supporting on the needle shank and/or the hook head.

In contract to the express instructions of the prior art as set forth above, the cover part is deliberately shortened in relation to the hook opening, which is automatically to the benefit of the rigidity of the cover part. This then facilitates the dimensioning of the cover part in such manner that by reason of its cross-section it is capable of carrying the stitch in each case without support on the needle shank and/or hook head. Thus the stitch is not in a position to cause the tip of the cover part to collide with the hook.

The dimensioning of the cover part can be facilitated in that it is of such configuration that it protrudes from the channel with its side remote from the bottom of the channel. This again is a departure from the instructions of the prior art as set forth above, where the important point is that the cover part does not protrude from the cross-section of the channel with its side remote from the bottom of the channel. Thus in the prior art the load by the stitch in each case is deliberately taken up by the needle shank. In the case where the cover part is of such configuration that its side remote from the channel bottom protrudes from the channel, the cover part takes up the loading by the stitch in each case even when the cover part is retracted into the channel, whereby the needle shank is relieved of load. Even for this configuration of the cover part it is advantageous that the cover part is shortened in relation to the hook opening.

So that now a stitch carried by a slider needle cannot slide over the transition of the cover part into the slider shank, this transition is expediently of such configuration that on its side remote from the bottom of the channel it extends approximately at right angles to the cover part. In this case to a certain extent there results a stop for a stitch carried by the slider needle, over which this stitch cannot slip in the direction away from the hook.

Figure 1:
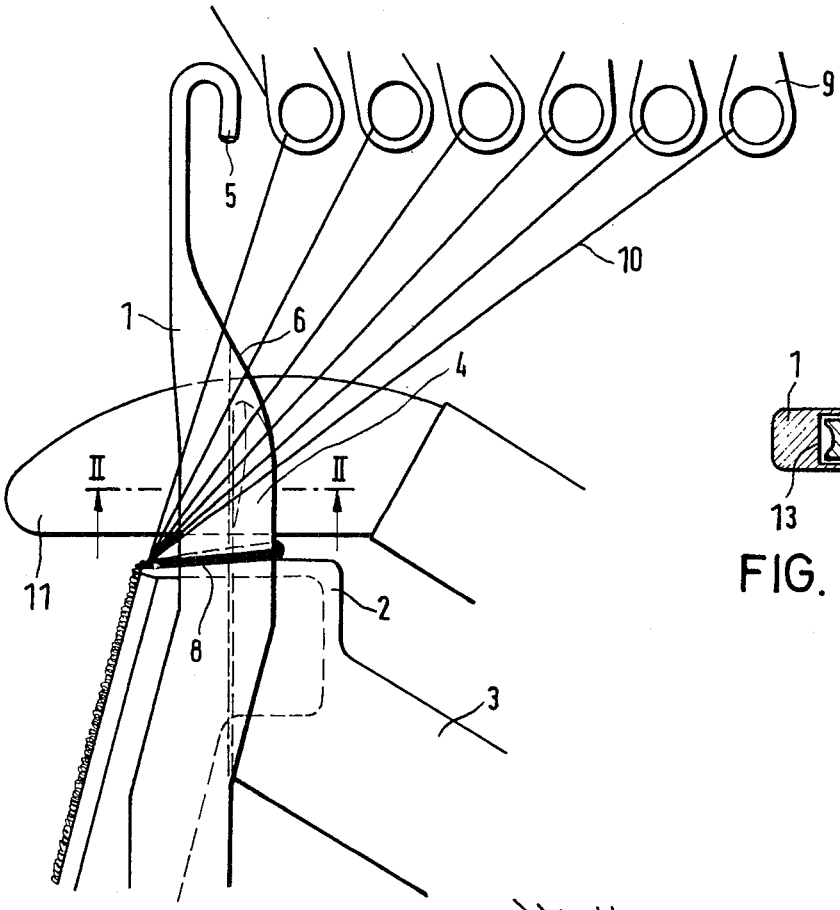
FIG. 1 shows a slider needle in the laying position, with a short cover part which is completely accomodated by the channel of the needle shank.
Figure 2:
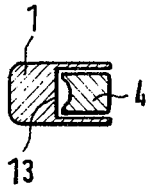
FIG. 2 shows a section along the line II—II.
Figure 3:
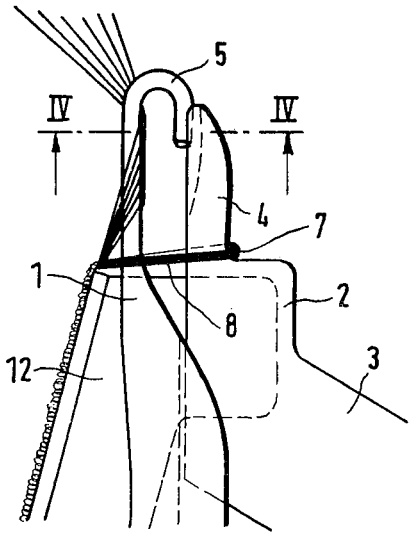
FIG. 3 shows the same slider needle in the closure position.

In FIGS. 1 and 2 a slider needle is shown having the needle shank 1 and the slider 2 which consists of the slider shank 3 and the cover part 4. The needle shank 1 merges into the hook head 5. Between the end of the hook head 5 and the obliquely extending breast 6 of the slider shank 1 there lies the hook opening, which is covered by the cover part 4 in the case of the closed position of the slider needle as illustrated in FIG. 3. On the other hand FIG. 1 shows what is called the laying position of the slider needle. The cover part 4 extends as far as the transition point 7 which forms approximately a right angle to the cover part 4, so that a stop results here for a stitch 8. The transition point 7 forming this stop thus prevents shifting of the stitch 8 in the direction away from the hook head 5.

In FIG. 1 there are also illustrated the eye-pointed needles 9 provided for the laying of the warp threads 10. In this context it is not necessary to discuss the function of the eye-pointed needles 9, since it is known. FIG. 1 further shows what is called the piercing comb 11 and the knock-over sinker 12, which in this context constitute likewise known components.

It appears from the cross-sectional drawing in FIG. 2 that the cover part 4 is completely accommodated by the channel of the needle shank 1, and maintains a spacing from the bottom 13 of the channel.

Figure 4:
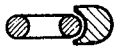
FIG. 4 shows a section along the line IV—IV.

From the cross-sectional drawing according to FIG. 4 it can be seen that the cover part 4, in the closure position as illustrated in FIG. 3, maintains a slight spacing from the hook head 5.

In the passage from the laying position according to FIG. 1 into the closure position according to FIG. 3, the stitch 8 is carried by the cover part 4, and the cover part 4 withstands the tension of the stitch 8 without need for the cover part 4 and/or the slider shank 3 to be supported on the needle shank 1 and the hook head 5 respectively. By reason of the shortness of the cover part 4, which in the closure position according to FIG. 3 protrudes with its transition point 7 far out of the channel of the needle shank 1, it is possible, with appropriate cross-section of the cover part 4, to impart adequate stability to the latter so that during the relative movement of cover part 4 and needle shank 1 the cover part 4 can come into contact with neither the channel bottom 13 nor the hook head 5.

Figure 5:
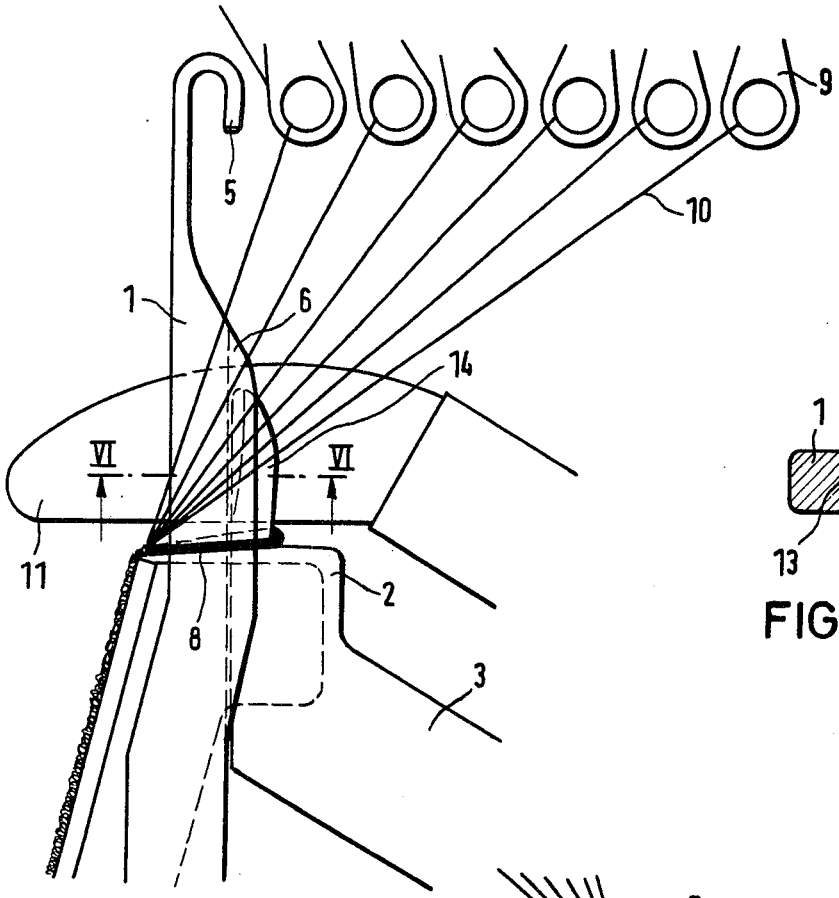
FIG. 5 shows a slider needle in the laying position, where a short cover part protrudes from the channel of the needle shank.
Figure 6:
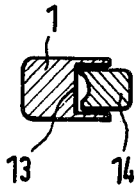
FIG. 6 shows a section along the line VI—VI.
Figure 7:
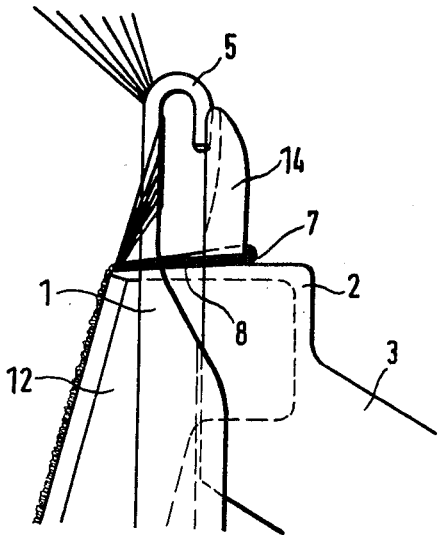
FIG. 7 shows the same slider needle in the closure position.

The forms of embodiment as illustrated in FIGS. 5–7 concern slider needles which conform in principle with that according to FIGS. 1 and 3. There is a difference solely in that in the form of embodiment according to FIGS. 5 and 7 the cover part 14 possesses such a cross-section that with its side remote from the channel bottom 13 it protrudes from the channel of the needle shank 1. Thus the cover part 14 receives especially great rigidity and is capable of taking up the traction of the stitch 8 even in the laying position as illustrated in FIG. 5. Otherwise, with regard to the further components, reference is made to the illustration in FIGS. 1 and 3.

It appears clearly from the sectional drawing in FIG. 6 how the cover part 14 protrudes from the channel of the needle shank 1, so that it can take over the carrying function for the stitch 8.

From the above explanations it appears that the cover part 4 or 14 is always in a position to carry a stitch 8 hanging on it, without possibility of the cover part 4 or 14 thereby being bent in a manner which could bring the slider shank 3 or the cover part 4/14 into contact with the needle shank 1 or the hook head 5 respectively. For this reason the needle shank 1 can be moved to and fro in relation to the cover part 4 or 14 without danger of the needle head 5 being then able to collide with the tip of the cover part 4 or 14. This signifies that a movement of the slider is not necessary for the closure of the hook opening. For this purpose it is sufficient if the needle shank with the hook is displaced in relation to the fast-held slider in such a way that the hook opening is closed. Then the slider 2 and needle shank 1 are moved in common in relation to the knockover sinker 12, whereby the stitch is stripped off from the slider needle. In the known form of embodiment according to the initially mentioned German Patent Sp. No. 1,760,140 on the other hand, on account of the inadequacy of rigidity of the cover part (their reference 7), the slider must first, by its own movement, close the hook opening, so that its tip can apply itself against the end of the hook for support. In the closure position then reached the stitch is still carried by the needle shank, because in the known arrangement the transition point from cover part to slider shank (there called angle point) lies in the channel of the needle shank. Only after the execution of this closure stroke by the slider in the known arrangement can the needle shank and slider then be retracted together in relation to the knock-over sinker, in order to strip the stitch from the slider needle.

On the basis of this comparison it appears that in the arrangement according to the invention it is possible to dispense with a closure stroke carried out by the slider itself. Consequently this arrangement can be used with advantage even when only a small number of warp threads, for example two warp threads, is to be laid. In this case in fact, by reason of the elimination of the closure stroke of the slider, an improved course of movement results rendering possible an increased working speed of the machine.

Inasmuch as the present invention is subject to many modifications and changes in details, it is intended that all matter contained in the foregoing description or shown in the accompanying drawings shall be interpreted as illustrative and not in a limiting sense.

What is claimed is:

1. Warp knitting machine with slider needles which have a needle shank of channel form with hook head and a slider which covers the hook opening of the needle shank with a cover part fitted on a slider shank, where the needle shank and slider are moved in relation to one another so that the slider does not come into contact with the bottom of the channel of the needle shank, characterized in that the cover part (4, 14) is so far shorter than the hook opening that on closure of the hook opening by placing of the end of the cover part (4, 14) opposite to the hook head (5) the transition (7) of the cover part (4, 14) into the slider shank (2, 3) has come out of the region of the channel, while the slider (2) possesses such a cross-section that it carries the stitch (8) in each case without supporting on the needle shank (1) and/or hook head (5).

2. Warp knitting machine according to claim 1, characterized in that the cover part (14) protrudes from the channel with its side remote from the channel bottom.

3. Warp knitting machine according to claim 1 or 2, characterized in that the transition (7) of the cover part (4, 14) into the slider (2) extends, on its side remote from the channel bottom (13), approximately at right angles to the cover part (4, 14).

* * * * *